US006150871A

United States Patent [19]

Yee

[11] Patent Number: 6,150,871

[45] Date of Patent: Nov. 21, 2000

[54] LOW POWER VOLTAGE REFERENCE WITH IMPROVED LINE REGULATION

[75] Inventor: Philip W. Yee, Los Altos, Calif.

[73] Assignee: Micrel Incorporated, San Jose, Calif.

[21] Appl. No.: 09/316,529

[22] Filed: May 21, 1999

[51] Int. Cl.[7] ..... G05F 1/10; G05F 3/02

[52] U.S. Cl. ..... 327/538; 327/540

[58] Field of Search ..... 327/538, 539, 327/540, 541, 543; 323/313, 315

[56] References Cited

U.S. PATENT DOCUMENTS

| | | | |
|---|---|---|---|
| Re. 34,772 | 11/1994 | Bernard et al. | 323/313 |
| 5,047,706 | 9/1991 | Ishibashi et al. | 323/313 |
| 5,084,665 | 1/1992 | Dixon et al. | 323/281 |
| 5,278,491 | 1/1994 | Nitta et al. | 323/313 |
| 5,451,860 | 9/1995 | Khayat | 323/314 |
| 5,506,496 | 4/1996 | Wrathall et al. | 323/316 |
| 5,512,855 | 4/1996 | Kimmura | 327/538 |
| 5,619,163 | 4/1997 | Koo | 327/539 |
| 5,686,823 | 11/1997 | Rapp | 323/313 |
| 5,767,664 | 6/1998 | Price | 323/907 |

*Primary Examiner*—Terry D. Cunningham
*Assistant Examiner*—Quan Tra
*Attorney, Agent, or Firm*—Skjerven Morrill MacPherson LLP; Carmen C. Cook; Brian D. Ogonowsky

[57] ABSTRACT

A voltage reference circuit includes a first transistor and a second transistor having their control terminals connected together, a first resistor coupled to a first current handling terminal of the first transistor, a second resistor coupled between an output node and a second current handling terminal of the second transistor, and a current mirror. The reference circuit provides an output voltage that is independent of variations in the supply voltage by adjusting the resistance of the first resistor in response to changes in the supply voltage. In one embodiment, the voltage at the control terminals of the first and second transistors is kept constant despite variations in the supply voltage. A first current and a second current flowing through the first and second transistors are also kept constant.

45 Claims, 3 Drawing Sheets

LOW POWER VOLTAGE REFERENCE WITH IMPROVED LINE REGULATION

BACKGROUND OF THE INVENTION

1. Field of the Invention

The invention generally relates to a voltage reference circuit and, in particular, the present invention relates to a voltage reference circuit with improved line regulation and having minimal operating voltage and current.

2. Background of the Invention

FIG. 1 is a conventional bandgap voltage reference circuit 10 for providing a reference voltage that is relatively constant over a sufficiently large temperature range. Bandgap reference circuit 10 includes a first bipolar transistor Q1 and a second bipolar transistor Q2 having their base terminals connected together. A current mirror formed by PMOS transistors M1 and M2 causes a first current $I_{C1}$ which flows through transistor M1 to be mirrored as an identical second current $I_{C2}$ which flows through transistor M2. Appropriate start-up circuitry (not shown) is provided to ensure that circuit 10 does not remain in the unstable equilibrium point where currents $I_{C1}$ and $I_{C2}$ are equal to zero.

In bandgap reference circuit 10, the emitter area of Q1 is made to be n times the emitter area of Q2, causing different current densities to flow in the transistors since the current mirror forces the currents of transistors Q1 and Q2 to be equal. Typically, the transistor size ratio n is in the range of 2 to 10. The unequal current densities of transistors Q1 and Q2 imply that if their currents are to be equal as required by the operation of the current mirror, then the base to emitter voltages ($V_{BE}$) of Q1 and Q2 must be different. The difference in the base to emitter voltages, denoted $\Delta V_{BE}$, is developed across a resistor R1. The voltage $\Delta V_{BE}$ is given by the equation:

$$\Delta V_{BE} = \frac{kT}{q}\ln(n)$$

where k is the Boltzmann's constant, T is temperature in Kelvin, and q is the electric charge. The same current that flows in resistor R1 also flows in resistor R2 and a voltage $V_{R2}$ develops across resistor R2. Voltage $V_{R2}$ is proportional to voltage $\Delta V_{BE}$ according to the equation:

$$V_{R2} = \Delta V_{BE}\left(\frac{R2}{R1}\right)$$

where R1 and R2 represent the resistance of resistors R1 and R2.

The output voltage Vout at node 16 is the sum of the voltage $V_{R2}$ and the voltage $V_{BE}$ of transistor Q2. It is well known that the voltage $V_{BE}$ of a bipolar transistor has a negative temperature coefficient while the voltage $\Delta V_{BE}$ has a positive voltage coefficient. By properly ratioing the resistance of resistors R1 and R2, a constant output voltage having approximately zero temperature coefficient can be obtained over a wide range of temperatures. For circuit 10 of FIG. 1, a nominal output voltage of approximately 1.25 volts is realized at node 16.

It is desirable to provide a bandgap voltage reference circuit where the operating voltage and operating current of the reference circuit can be kept at minimal levels, i.e., the reference circuit must consume minimal power in operation. Voltage reference circuit 10 of FIG. 1 achieves low power consumption by utilizing only two current paths from the power supply Vs (node 12) to the ground potential (node 14). By providing only two current paths, the supply current which flows in circuit 10 in operation is kept low. Voltage reference circuit 10 also allows the supply voltage Vs to be at a minimum by using PMOS transistors to implement the current mirror (i.e., transistors M1 and M2). PMOS transistor M2 requires only a minimal voltage between supply voltage Vs (node 12) and voltage Vout (node 16) for its operation as a current mirror. Furthermore, in reference voltage circuit 10, PMOS transistors M1 and M2 are long channel devices so as to maximize their output impedance.

However, conventional voltage reference circuits such as reference circuit 10 exhibit poor line regulation characteristics. Line regulation is defined as the dependence of the output voltage (Vout) on the power supply voltage (Vs). Reference voltage circuit 10 has poor line regulation characteristics due to the finite Early voltage value of transistor Q1. The Early voltage ($V_A$) is an extrapolated voltage parameter modeling the variation of the collector current $I_C$ with respect to the collector to emitter voltage $V_{CE}$ in a bipolar transistor. For a description of the Early voltage of a bipolar transistor and the Early effect on the transistor output characteristics, see Gray and Meyer, "Analysis and Design of Integrated Circuits," 2nd ed., 1984, John Wiley & Sons, Inc., pages 18–19.

Referring to FIG. 1, as the supply voltage Vs (node 12) varies, voltage $V_{CE}$ of transistor Q1 is caused to vary accordingly. Because transistor Q1 has a finite Early voltage, the change in voltage $V_{CE}$ of transistor Q1 causes its collector current $I_{C1}$ to also vary. Because current $I_{C1}$, is mirrored to current $I_{C2}$ of transistor Q2, current $I_{C2}$ flowing through resistor R2 varies as a result of the variation in supply voltage Vs. Therefore, the output voltage Vout (node 16) of voltage reference circuit 10 varies with the supply voltage Vs. Even though voltage reference circuit 10 is capable of providing a constant output voltage over a wide range of temperature, the output voltage exhibits the undesirable characteristics of poor line regulation.

Prior art solutions to control the line regulation character are unsatisfactory because the solutions involve placing additional voltage or current burdens on the circuit, making it undesirable for minimal power operations.

Therefore, it is desirable to provide a voltage reference circuit with improved line regulation characteristics which can be operated with minimal operating voltage and current.

SUMMARY OF THE INVENTION

In accordance with one embodiment of the present invention, a voltage reference circuit includes a first transistor and a second transistor having their control terminals connected together, a first resistor coupled to a first current handling terminal of the first transistor, a second resistor coupled between an output node and a second current handling terminal of the second transistor, and a current mirror. The reference circuit provides an output voltage at the output node that is virtually independent of variations in the supply voltage by dynamically adjusting the resistance of the first resistor in response to changes in the supply voltage. The voltage at the control terminals of the first and second transistors is thus kept constant despite variations in the supply voltage. A first current and a second current flowing through the first and second transistors, respectively, are also kept constant.

In accordance with another embodiment of the present invention, a voltage reference circuit includes a first transistor, a second transistor, a first resistor and a second resistor connected in series between an output node and a second current handling terminal of the second transistor, and a current mirror. A first current flowing through the first transistor is kept constant with variations in the supply voltage by adjusting the base to emittier $V_{BE}$ voltage of the first transistor. The voltage $V_{BE}$ is adjusted in an amount sufficient to offset any changes in the first current that would be caused by variations in the supply voltage if the voltage $V_{BE}$ remained constant. The voltage $V_{BE}$ is adjusted by varying the resistance of the first resistor. In yet another embodiment, the voltage $V_{BE}$ is adjusted by varying the resistance of both the first and second resistors.

The voltage reference circuit of the present invention provides a reference voltage at the output node that is temperature independent and supply voltage independent over a large range of temperature and supply voltages. Furthermore, the voltage reference circuit improves line regulation without adding voltage or current burdens on the circuit.

The present invention is better understood upon consideration of the detailed description below and the accompanying drawings.

BRIEF DESCRIPTION OF THE DRAWINGS

In the present disclosure, like objects which appear in more than one figure are provided with like reference numerals.

DETAILED DESCRIPTION OF THE PREFERRED EMBODIMENTS

A low power voltage reference circuit with improved line regulation characteristics is described. The voltage reference circuit of the present invention improves line regulation without placing any additional voltage or current demands on the circuit.

Figure 2:
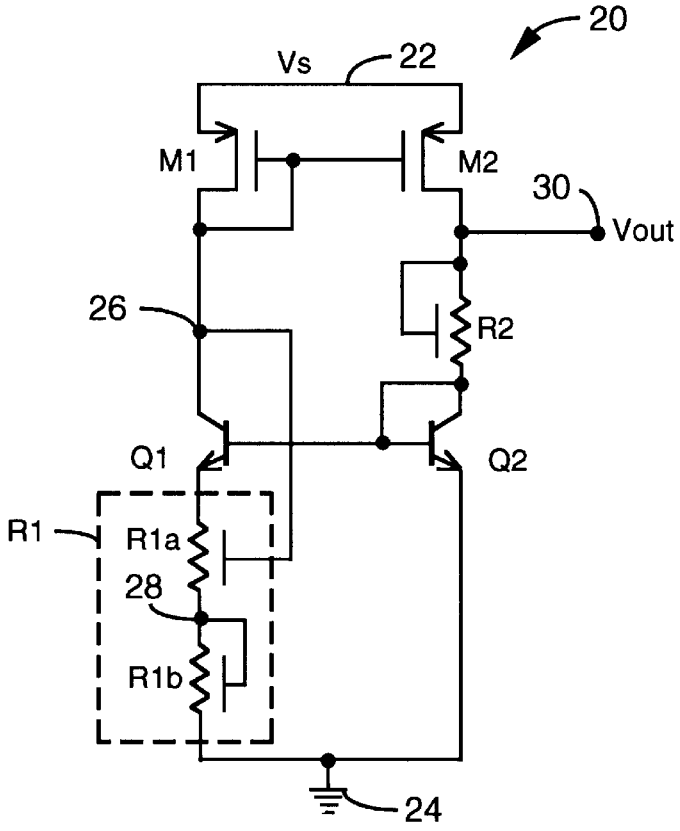
FIG. 2 is a circuit schematic of a voltage reference circuit according to a first embodiment of the present invention.

FIG. 2 is a circuit schematic of a voltage reference circuit 20 according to a first embodiment of the present invention. Voltage reference circuit 20 includes a first transistor Q1 and a second transistor Q2. Transistors Q1 and Q2 are NPN bipolar transistors. In the present embodiment, the size of transistor Q1 is n times the size of transistor Q2. Typically, the size of a bipolar transistor is determined by its emitter area. Transistor Q2 is diode connected, i.e., its base and collector terminals are tied together. The base terminals of transistors Q1 and Q2 are also tied together. A resistor R1 including a pair of serially connected resistors R1*a* and R1*b* are connected between the emitter terminal of transistor Q1 and ground potential (node 24). Another resistor R2 is connected between the collector terminal of transistor Q2 and an output node 30 providing the reference output voltage Vout.

Voltage reference circuit 20 further includes a current mirror formed by PMOS transistors M1 and M2. Of course, other transistor types can be used, such as bipolar transistors. Transistor M1 is connected between a power supply voltage Vs (node 22) and the collector terminal of transistor Q1. Transistor M1 has its gate terminal and its drain terminal connected together. The gate terminals of transistors M1 and M2 are tied together. Transistor M2 is connected between the power supply voltage Vs (node 22) and output node 30.

Figure 5:
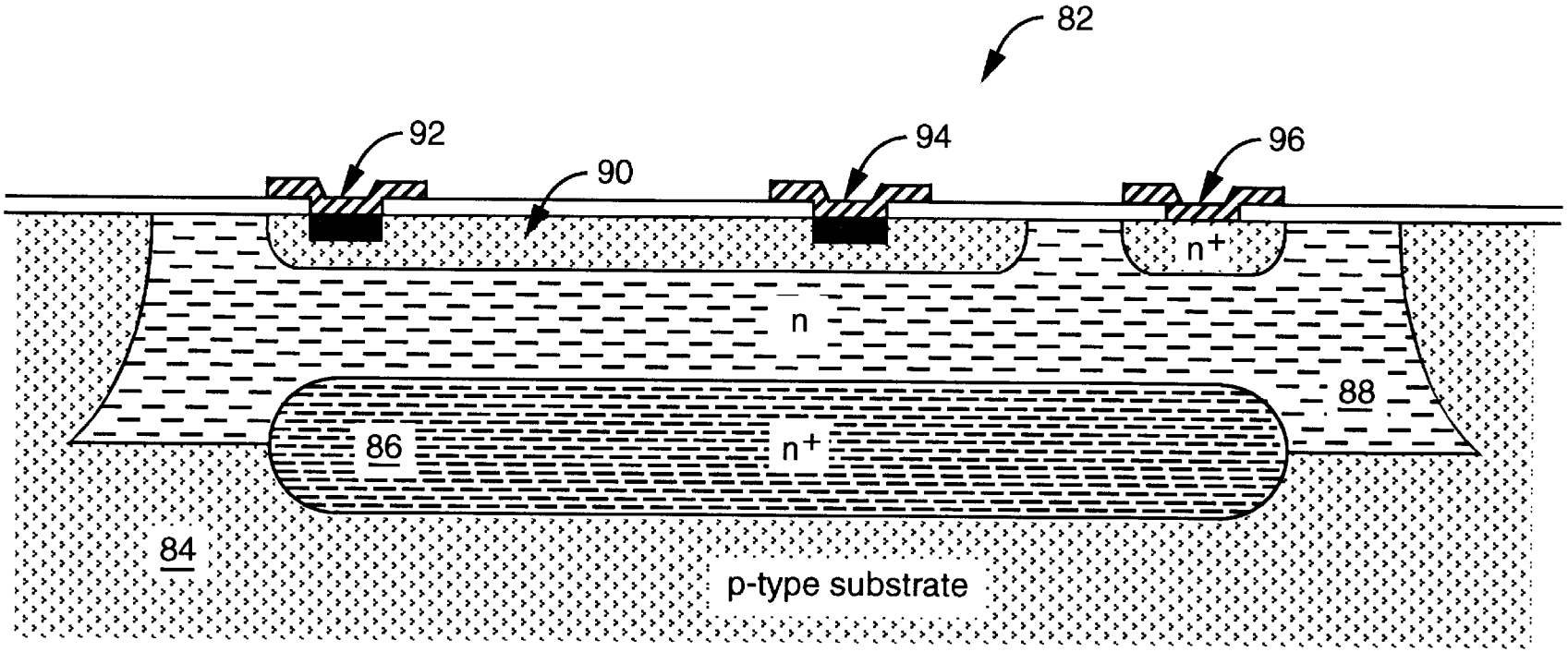
FIG. 5 is a cross-sectional view of a diffusion resistor structure.

In voltage reference circuit 20, resistors R1*a,* R1*b* and R2 are diffusion resistors. Diffusion resistors are well known in the art. Examples of diffused resistors are described in pages 113–118 of Gray and Meyer, "Analysis and Design of Integrated Circuits" 2nd ed., 1984, John Wiley & Sons, Inc., which is incorporated by reference in its entirety. The diffusion resistors of the present embodiment utilize a base-diffused resistor structure similar to that shown on page 114 of Gray and Meyer and in FIG. 5. FIG. 5 is a cross-sectional view of a diffusion resistor 82. Diffusion resistor 82 is fabricated on a p-type substrate 84 and is contained in an n-type epitaxial layer 88 including an n+ buried layer 86. Resistor 82 is defined by a p-type diffusion region 90. Resistor contacts 92 and 94 are formed at the two ends of p-type diffusion region 90 in two p+ diffusion regions. An n+ contact to epitaxial layer 88 forms the body bias terminal 96. The junction between p-type diffusion region 90 and n-type epitaxial layer 88 is always reverse biased. A positive voltage applied to body bias terminal 96 varies the width of the depletion region formed at the junction, thereby modulating the resistance of resistor 82.

In reference circuit 20, Resistors R1*b* and R2 have fixed resistance. A fixed resistance diffusion resistor is realized by tying the body bias terminals of the resistor to the most positive end of the resistor. Referring to FIG. 2, the body bias terminal of resistor R1*b* is connected to node 28 which is one end of resistor R1*b*. Similarly, the body bias terminal of resistor R2 is connected to node 30 which is one end of resistor R2. Resistor R1*a,* on the other hand, has a variable resistance. The body terminal of resistor R1*a* is connected to node 26. Thus, the resistance of resistor R1*a* is modulated by the collector voltage of transistor Q1, denoted $V_{C1}$.

In the present embodiment and in the embodiments which follow, resistors R1 and R2, including its separate resistive components, are constructed as diffusion resistors such as resistor 82 of FIG. 5. However, this is illustrative only and is not intended to limit the present invention to a resistor structure as that shown in FIG. 5 only. In fact, one skilled in the art will appreciate that other diffused resistor or junction resistor structures such as those described in Gray and Meyer can be used. Also, resistor structures other than a junction resistor can also be used. Moreover, one skilled in the art will appreciate that the variable resistors in the embodiments of the present invention can be any type of variable resistors whose resistance can be controlled by a voltage.

Figure 1:
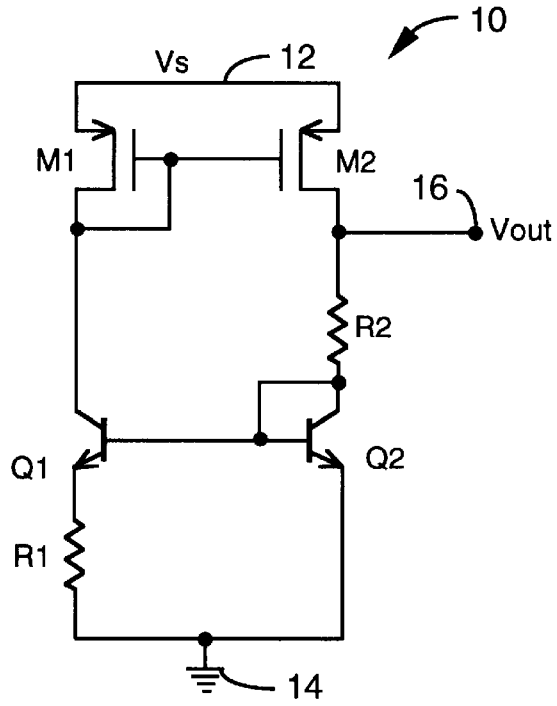
FIG. 1 (PRIOR ART)
FIG. 1 is a circuit schematic of a conventional voltage reference circuit.

Output voltage Vout (node 30) of voltage reference circuit 20 is the sum of the voltage across resistor R2 (denoted $V_{R2}$) and the base to emitter voltage $V_{BE2}$ of transistor Q2. Voltage reference circuit 20 operates in a manner similar to voltage reference circuit 10 of FIG. 1 to generate a bandgap reference voltage (voltage Vout) of approximately 1.25 volts and having substantially zero temperature coefficient.

In accordance with the present invention, voltage reference circuit 20 ensures that voltage Vout is independent of variations in the supply voltage Vs by maintaining the current $I_{C2}$ flowing through resistor R2 and transistor Q2 constant, despite variations in the supply voltage Vs. Current $I_{C2}$ is mirrored by the current mirror of reference circuit 20 (i.e., transistors M1 and M2) from a current $I_{C1}$ flowing in the collector terminal of transistor Q1. When well-known start-up circuitry (not shown) is employed to set reference circuit 20 to the desired operating point, currents $I_{C1}$ and $I_{C2}$ are equal but not to zero. Therefore, as long as current $I_{C1}$ is held constant with respect to variations in the supply voltage Vs, then current $I_{C2}$ is also held constant and the output voltage Vout does not vary with voltage Vs. In reference circuit 20, current $I_{C1}$ is kept constant by adjusting the base to emitter voltage of transistor Q1, $V_{BE1}$, through the operation of variable resistor R1*a*.

In operation, as the supply voltage Vs (node 22) varies, the gate to source voltage $V_{gs}$ of transistor M1 is kept relatively constant since current $I_{C1}$ is relatively constant. Therefore, the collector voltage $V_{C1}$ of transistor Q1 (node 26) varies with voltage Vs. Without the novel voltage compensation technique of the present invention, current $I_{C1}$ of transistor Q1 will vary due to the changes in collector voltage $V_{C1}$ which, in turn, causes current $I_{C2}$ to also vary. However, in the present embodiment, variations in current $I_{C1}$, resulting from a finite Early voltage, are prevented by adjusting the resistance of resistor R1*a* which adjusts the base to emitter voltage $V_{BE1}$ of transistor Q1. In this manner, a constant base voltage $V_B$ at the base of transistor Q1 is maintained and both currents $I_{C1}$ and $I_{C2}$ are kept constant despite variations in supply voltage Vs.

As described above, current $I_{C1}$ is kept constant through the operation of variable resistor R1*a*. In reference circuit 20, because the body bias terminal of resistor R1*a* is connected to node 26, any variation in collector voltage $V_{C1}$ of transistor Q1 is applied to resistor R1*a*. If collector voltage $V_{C1}$ increases, the body bias to resistor R1*a* increases, causing the resistance of resistor R1*a* to increase as well. The resistance of resistor R1*a* is increased by an amount sufficient to maintain the required constant current $I_{C1}$ through the resistor. As a result, the voltage across resistor R1*a*, $V_{R1a}$, increases. The increase in voltage $V_{R1a}$ causes a corresponding decrease in voltage $V_{BE1}$ of transistor Q1. Voltage $V_{BE1}$ of transistor Q1 is decreased just enough to offset any increase in $I_{C1}$ due to the increase in collector voltage $V_{C1}$. Thus, current $I_{C1}$ is restored to a constant value and base voltage $V_B$ is kept constant. Current $I_{C2}$, mirrored from current $I_{C1}$, is also kept constant despite variations in supply voltage Vs so that output voltage Vout (node 30) is also independent of variations in supply voltage Vs.

In the present embodiment, resistor R1 is shown as including two resistive components, R1*a* and R1*b*, of which only resistor R1*a* has variable resistance. The present embodiment permits only a portion of the total resistance of resistor R1 to be varied to compensate for variations in the collector voltage $V_{C1}$ due to variations in supply voltage Vs. The present embodiment has the advantage of limiting the magnitude of change in the voltage across R1, thus providing for fine control of the compensating voltage $V_{R1a}$. In another embodiment, resistor R1 may include only a single variable resistor. In such an embodiment, the entire resistance of resistor R1 is varied by the collector voltage $V_{C1}$ (node 26), creating a larger change in the compensating voltage $V_{R1}$ (the voltage across the entire resistor R1).

Furthermore, in the present embodiment, the body bias terminal of resistor R1*a* is connected to the collector terminal of transistor Q1. In another embodiment, the body bias terminal of resistor R1 or resistor R1*a* (if resistor R1 is split) can be connected directly to the supply voltage Vs. Because the voltage across transistor M1, i.e., the drain to source voltage $V_{ds}$, remains constant as supply voltage Vs varies, the entire variation in supply voltage Vs is reflected at the collector terminal of transistor Q1. Thus, the resistance of resistor R1 can be modulated by either the collector voltage of transistor Q1 or the supply voltage Vs directly to obtain the same magnitude of change in resistance.

The derivation of the design equation for voltage reference circuit 20 of the present invention will now be described. Referring to FIG. 2, the base voltage $V_B$ of transistor Q2 is given by:

$$V_B = V_{BE1} + V_{R1}$$

where $V_{R1}$ is the voltage across resistor R1 and $V_{BE1}$ is the base to emitter voltage of transistor Q1. Voltages $V_{BE1}$ and $V_{R1}$ are varied in response to variations in supply voltage Vs in order to keep base voltage $V_B$ constant. Voltage $V_{R1}$ is varied while still maintaining a constant current $I_{C1}$ flowing through resistor R1 by varying its resistance accordingly. A parameter a is defined as the first order voltage coefficient of resistor R1. Because collector voltage $V_{C1}$ (node 26) controls the body bias of resistor R1, the resistance of resistor R1 as a function of the collector to emitter voltage $V_{CE1}$ of transistor Q1 is given by:

$$R1 = R1_0(1 + aV_{CE1})$$

where $R1_0$ is the resistance of resistor R1 at zero-volt body bias. A fractional change in voltage $V_{R1}$, termed $\Delta V_{R1}$, is given by:

$$\frac{\Delta V_{R1}}{V_{R1}} = aV_{CE1},$$

assuming that the current through the resistor is kept constant. As described above, the magnitude of change in voltage $V_{R1}$ for a given $V_{CE1}$ can be controlled by dividing resistor R1 into resistors R1*a* and R1*b* and applying the body bias of voltage $V_{CE1}$ to resistor R1*a* only as shown in FIG. 2. For the embodiment shown in FIG. 2, the fractional change in voltage $V_{R1}$ becomes:

$$\frac{\Delta V_{R1}}{V_{R1}} = faV_{CE1}, \quad \text{where } f = \frac{R1a}{R1a + R1b}.$$

As described above, voltage $V_{R1}$ equals to a voltage $\Delta V_{BE}$ which is the difference in the base to emitter voltages of transistors Q1 and Q2. The voltage $\Delta V_{BE}$ is given by the equation:

$$\Delta V_{BE} = \frac{kT}{q}\ln(n).$$

Therefore, the change in voltage $V_{R1}$ can be expressed as:

$$\Delta V_{R1} = faV_{CE1}\frac{kT}{q}\ln(n).$$

On the other hand, the change in the base to emitter voltage of transistor Q1, $\Delta V_{BE1}$, required to offset the increase in the collect current due to the Early effect is derived as follows. The dependence of collector current $I_{C1}$ of transistor Q1 on voltage $V_{CE1}$ can be expressed as:

$$I_{C1} = I_0\left(1 + \frac{V_{CE1}}{V_A}\right)$$

where $I_0$ is the extrapolated collector current at $V_{CE1}$=0 volt and $V_A$ is the Early voltage of transistor Q1. The change in base to emitter voltage as a function of the collector current is given by:

$$\Delta V_{BE1} = \frac{kT}{q}\ln\left(\frac{I_{C1}}{I_0}\right) = \frac{kT}{q}\ln\left(1 + \frac{V_{CE1}}{V_A}\right).$$

Expanding the logarithmic term and making the assumptions that $V_{CE1}$ is typically limited to about 6 volts and $V_A$ is typically over 100 volts, voltage $\Delta V_{BE1}$ can be approximated as:

$$\Delta V_{BE1} = \frac{kT}{q}\left(\frac{V_{CE1}}{V_A}\right).$$

The above equation describes how much change in voltage $V_{BE1}$ is required to keep $I_{C1}$ through transistor Q1 constant, and this change must be equal to the change in voltage across resistor R1. Equating voltage $\Delta V_{R1}$ and $\Delta V_{BE1}$ provides the design equation required to keep the collect current $I_{C1}$ and the base voltage $V_B$ constant. The design equation is expressed as:

$$f = \frac{1}{aV_A\ln(n)}.$$

Since f is a maximum of one, an adequate adjustment range is achieved if the voltage coefficient a of resistor R1 is:

$$a \geq \frac{1}{V_A\ln(n)}.$$

For typical values of Early voltage $V_A$ of 100 volts and a transistor size ratio n of 4, a is required to be greater than or equal to 0.0072 which is a condition easily achieved in standard integrated circuit manufacturing processes.

In the present embodiment, the transistor size ratio n is in the range of 2 to 10, typically n is 4. When current $I_{C1}$ is set to be 1 $\mu$A, the resistance of resistor R1 is in the range of 18 kΩ to 60 kΩ, typically the resistance is 36 kΩ. The resistance of resistor R2 is approximately 500 kΩ.

Voltage reference circuit 20 of the present embodiment provides a reference voltage Vout that is temperature independent and supply voltage independent. Furthermore, voltage reference circuit 20 improves line regulation without adding voltage or current burdens on the circuit. The architecture of reference circuit 20 utilizes only two current paths, thereby ensuring minimal power consumption in operation. Voltage reference circuit 20 is particularly suitable for use in applications where minimal power consumption is required, such as a battery operated voltage monitor circuit.

According to a second embodiment of the present invention, the current consumption of reference circuit 20 is further reduced by making the size of transistor Q1 equal to the size of transistor Q2, i.e., the transistor size ratio n is one. Instead, the size of transistor M2 is made to be n times larger than the size of transistor M1 to provide the proper current density ratio of currents $I_{C1}$ and $I_{C2}$. The resistance of resistor R1 is also made n times larger than in the first embodiment. In this manner, a reduction of (n−1)/2n in total supply current is realized.

Figure 3:
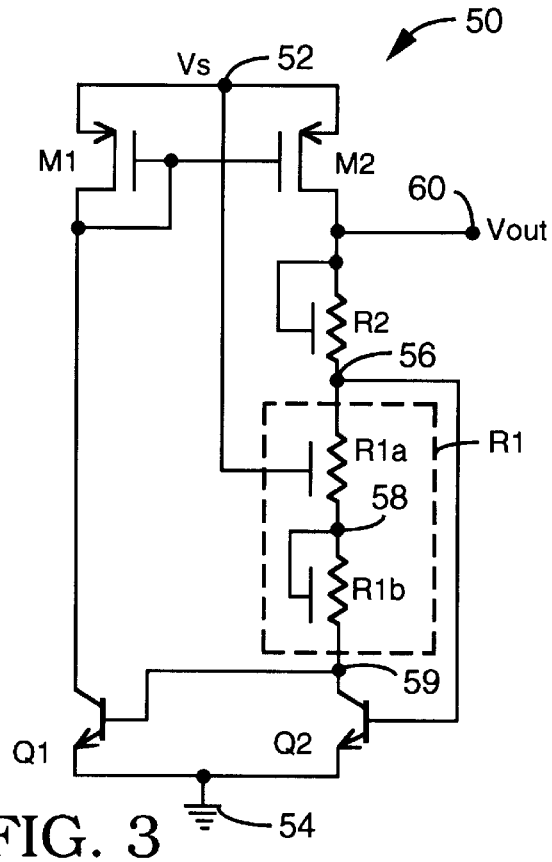
FIG. 3 is a circuit schematic of a voltage reference circuit according to a third embodiment of the present invention.

FIG. 3 is a circuit schematic of a voltage reference circuit 50 according to a third embodiment of the present invention. In the second embodiment described above, because the resistance of resistor R1 needs to be made n times larger than in the first embodiment, resistor R1 consumes a much larger device area in the fabrication of the reference circuit, thus increasing manufacturing cost. In accordance with the third embodiment of the present invention, the sizes of transistors Q1 and Q2 are made equal to further reduce current consumption; however, resistor R1 is repositioned so that its resistance can be maintained at the same value as in the first embodiment. The third embodiment of the present invention achieves further reduction in power consumption without the corresponding increase in device area and production cost.

Referring to FIG. 3, voltage reference circuit 50 includes bipolar transistors Q1 and Q2, having equal sizes, and a current mirror formed by PMOS transistors M1 and M2 having unequal sizes. Specifically, the size (channel width) of transistor M2 is n times larger than the size of transistor M1. The base terminal of transistor Q1 is connected to the collector terminal of transistor Q2 (node 59). Reference circuit 50 further includes a resistor R1 and a resistor R2 which are connected in series between voltage output node 60 and the collector terminal of transistor Q2 (node 59). The base terminal of transistor Q2 is connected to a node 56, between resistor R1 and resistor R2.

Resistor R1 of reference circuit 50 includes two resistive components, R1*a* and R1*b*, of which resistor R1*a* has variable resistance. The body bias terminal of resistor R1*a* is tied to supply voltage Vs (node 52). Thus, the resistance of resistor R1*a* is modulated by the supply voltage Vs. Resistor R1*b* has its body bias terminal tied to one end of the resistor (node 58), thus resistor R1*b* has fixed resistance. Resistor R2 also has its body bias terminal tied to one end of the resistor (node 60), thus resistor R2 also has fixed resistance. In the present embodiment, resistor R1 is split into two resistive components of which only one has variable resistance. As described above in reference to circuit 20, resistor R1 can be a single resistor having its entire resistance being variable.

In the present embodiment, resistor R1 has been repositioned from the $I_{C1}$ current path to the $I_{C2}$ current path to take advantage of the larger current flowing in transistor Q2. Therefore, resistor R1 can be made the same size as in the first embodiment (reference circuit 20 of FIG. 2) even though the sizes of transistor Q1 and Q2 have been made equal.

In reference circuit 50 of FIG. 3, currents $I_{C1}$ and $I_{C2}$ are not equal in operation as in the previous embodiments. Current $I_{C2}$ is made n times greater than current $I_{C1}$ to create the difference in current densities in transistors Q1 and Q2 needed to generate the difference in base to emitter voltages, $\Delta V_{BE}$. In reference circuit 50, $\Delta V_{BE}$ appears across resistor R1 between nodes 56 and 59.

Reference circuit 50 operates to keep current $I_{C1}$ constant by adjusting the base to emitter voltage $V_{BE1}$ of transistor Q1 through the operation of variable resistor R1. Because the resistance of resistor R1 is modulated by supply voltage Vs, as voltage Vs varies, the resistance of resistor R1 varies, and voltage $V_{R1}$ across the resistor also varies accordingly. The increase in voltage $V_{R1}$ causes the voltage applied to the base terminal of transistor Q1 to decrease. As a result, the base to emitter voltage $V_{BE1}$ of transistor Q1 is adjusted as the supply voltage Vs varies to compensate for any variation in current $I_{C1}$ due to variations in the supply voltage Vs.

For example, if supply voltage Vs increases, the resistance of resistor R1*a* is increased due to the increase in supply voltage Vs. As a result, voltage $V_{R1}$ (between nodes 56 and 59) increases, causing $V_{BE1}$ of transistor Q1 to decrease. The decrease in voltage $V_{BE1}$ leads to a decrease in collector current $I_{C1}$ which offsets any increase in current $I_{C1}$ due to the increase in supply voltage Vs. Therefore, currents $I_{C1}$ and $I_{C2}$ are thus maintained constant, and output voltage Vout (node 60) is also maintained constant despite variations in supply voltage Vs.

In the above described embodiments, resistor R1 is divided so only part of resistor R1 is variable. However, it is often difficult to divide resistor R1 into two components because its resistance value is much smaller than resistor R2. Alternately, it is often more convenient to divide resistor R2 into two components while still maintaining resistance match with resistor R1.

Figure 4:
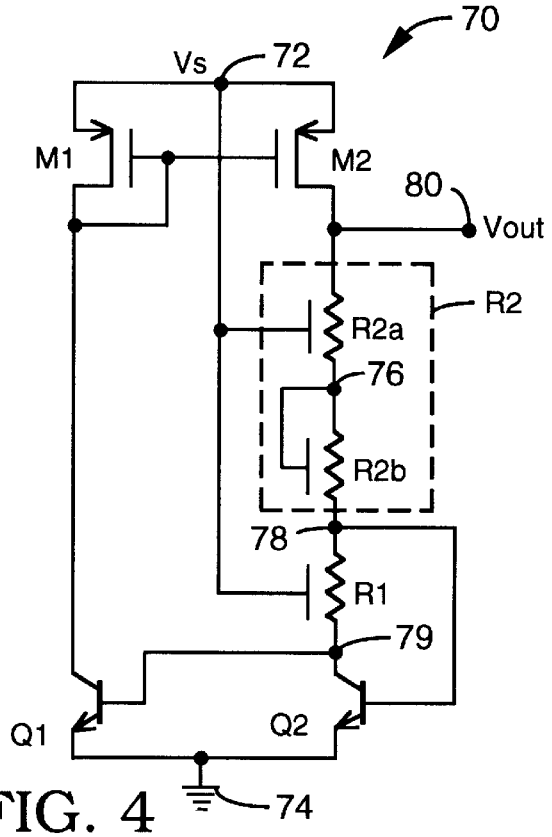
FIG. 4 is a circuit schematic of a voltage reference circuit according to a fourth embodiment of the present invention.

FIG. 4 is a circuit schematic of a voltage reference circuit 70 according to a fourth embodiment of the present invention. Reference circuit 70 is constructed in the same manner as reference circuit 50 of FIG. 3. However, in reference circuit 70, resistor R1 has a single variable resistive component, and the body bias of resistor R1 is applied to the entire resistor. The resistance of resistor R1 is modulated by supply voltage Vs (node 72). On the other hand, resistor R2 of reference circuit 70 is split into two resistive components, R2*a* and R2*b*. Resistor R2*a* is a variable-resistance resistor having its body bias terminal connected to supply voltage Vs (node 72). Resistor R2*b* is a fixed-resistance resistor having its body bias terminal connected to one end of the resistor (node 76).

In reference circuit 70, the entire resistance of resistor R1 is being modulated in response to variation in supply voltage Vs, which results in an overadjustment of the collector current $I_{C1}$ in transistor Q1. Specifically, when the supply voltage Vs increases, the entire resistance of resistor R1 is being modulated and voltage $V_{R1}$ increases. The base to emitter voltage $V_{BE1}$ of transistor Q1 is being decreased more than necessary to compensate for any increase in current $I_{C1}$. As a result, $I_{C1}$ and $I_{C2}$ actually decrease as supply voltage Vs increases. Reference circuit 70 compensates for the overadjustment through the operation of variable resistor R2*a*. By providing resistor R2*a* having its body bias also controlled by supply voltage Vs, voltage Vout (node 80) is restored to a level sufficient to compensate for the decrease in current $I_{C2}$ caused by the overadjustment by resistor R1. Reference circuit 70 is thus able to maintain a constant output voltage Vout (node 80) that is independent of variations in supply voltage Vs.

In the voltage reference circuits of the above described embodiments, improvement in line regulation characteristics of up to 40 times over conventional voltage reference circuits have been observed. In one embodiment, the output reference voltage is maintained constant over variations in supply voltage of 1.5 to 6 volts. In the above analysis, a constant Early voltage $V_A$ is assumed. In practice, the Early voltage of a transistor may not be constant and may vary as much as ±50% from its nominal value over variations in the process. In such case, the design parameter f can be adjusted using any standard trim technique. However, even if trimming is not used to compensate for variations in Early voltage, simulation results reveal that the reference circuit of the above embodiments improves line regulation characteristics by a minimum of 70% over conventional reference circuits.

In the present description, start-up circuitry for the reference circuits are not shown. However, one skilled in the art will appreciate that any conventional start-up circuitry may be used to bias the voltage reference circuits of the present inventions into the proper operation point.

The above detailed description is provided to illustrate the specific embodiments of the present invention and is not intended to be limiting. Numerous modifications and variations within the scope of the present invention are possible. The present invention is defined by the appended claims thereto.

I claim:

1. A voltage reference circuit comprising:

a current mirror electrically coupled to a first supply voltage, said current mirror having a first current terminal and a second current terminal;

a first transistor having a first current handling terminal, a second current handling terminal coupled to said first current terminal of said current mirror, and a control terminal;

a second transistor having a first current handling terminal coupled to a second supply voltage, a second current handling terminal, and a control terminal coupled to said second current handling terminal, said control terminal also coupled to said control terminal of said first transistor;

a first resistor coupled between said first current handling terminal of said first transistor and said second supply voltage, said first resistor having a variable resistance, said resistance being modulated by a first bias voltage related to said first supply voltage; and a second resistor coupled between said second current terminal of said current mirror and said second current handling terminal of said second transistor.

2. The circuit of claim 1, wherein said second current terminal of said current mirror provides a reference voltage, and wherein said reference voltage is proportional to a bandgap voltage and is substantially constant over a first temperature range and a first voltage range of said first supply voltage.

3. The circuit of claim 1, wherein said first bias voltage is a voltage at said second current handling terminal of said first transistor.

4. The circuit of claim 1, wherein said first bias voltage is said first supply voltage.

5. The circuit of claim 1, wherein said first resistor comprises:

a third resistor having a variable resistance being modulated by said first bias voltage; and a fourth resistor having a fixed resistance.

6. The circuit of claim 5, wherein said first bias voltage is a voltage at said second current handling terminal of said first transistor.

7. The circuit of claim 5, wherein said first bias voltage is said first supply voltage.

8. The circuit of claim 5, wherein said second, third, and fourth resistors are diffusion resistors.

9. The circuit of claim 8, wherein said resistance of said third resistor is modulated by adjusting a body bias voltage of said resistor.

10. The circuit of claim 1, wherein said first and second resistors are diffusion resistors.

11. The circuit of claim 10, wherein said resistance of said first resistor is modulated by adjusting a body bias voltage of said resistor.

12. The circuit of claim 1, wherein said first and second transistors are bipolar transistors.

13. The circuit of claim 12, wherein said first and second transistors are NPN bipolar transistors.

14. The circuit of claim 1, wherein said current mirror comprises:

a third transistor having a first current handling terminal coupled to said first supply voltage, and a second current handling terminal coupled to a control terminal and to said second current handling terminal of said first transistor; and a fourth transistor having a control terminal coupled to said control terminal of said third transistor, a first current handling terminal coupled to said first supply voltage, and a second current handling terminal coupled to said output terminal of said circuit.

15. The circuit of claim 14, wherein said third and fourth transistors are MOS transistors.

16. The circuit of claim 15, wherein said third and fourth transistors are P-channel MOS transistors.

17. The circuit of claim 14, wherein said first transistor has a first size and said second transistor has a second size, said first size being n times greater than said second size, and wherein said third transistor has a third size and said fourth transistor has a fourth size, said third and fourth sizes being substantially equal.

18. The circuit of claim 17, wherein said first and second transistors are NPN bipolar transistors, and each of said first and second sizes is associated with an emitter area of each of said transistors.

19. The circuit of claim 14, wherein said first transistor has a first size and said second transistor has a second size, said first size being substantially equal to said second size, and wherein said third transistor has a third size and said fourth transistor has a fourth size, said fourth size being n times greater than said third size.

20. The circuit of claim 19, wherein an operating current of said circuit is less than 1 $\mu$A.

21. A voltage reference circuit comprising:

a current mirror electrically coupled to a first supply voltage, said current mirror having a first current terminal and a second current terminal;

a first transistor having a first current handling terminal coupled to a second supply voltage, a second current handling terminal coupled to said first current terminal of said current mirror, and a control terminal;

a second transistor having a first current handling terminal coupled to said second supply voltage, a second current handling terminal coupled to said control terminal of said first transistor, and a control terminal coupled to a first node;

a first resistor coupled between said second current handling terminal of said second transistor and said first node, said first resistor having a variable resistance, said resistance being modulated by a first bias voltage related to said first supply voltage; and a second resistor coupled between said first node and said second current terminal of said current mirror.

22. The circuit of claim 21, wherein said second current terminal of said current mirror provides a reference voltage, and wherein said reference voltage is proportional to a bandgap voltage and is substantially constant over a first temperature range and a first voltage range of said first supply voltage.

23. The circuit of claim 21, wherein said first bias voltage is said first supply voltage.

24. The circuit of claim 21, wherein said first resistor comprises:

a third resistor having a variable resistance being modulated by said first bias voltage, and a fourth resistor having a fixed resistance.

25. The circuit of claim 24, wherein said first bias voltage is said first supply voltage.

26. The circuit of claim 24, wherein said second, third, and fourth resistors are diffusion resistors.

27. The circuit of claim 26, wherein said resistance of said third resistor is modulated by adjusting a body bias voltage of said resistor.

28. The circuit of claim 21, wherein said first and second resistors are diffusion resistors.

29. The circuit of claim 28, wherein said resistance of said first resistor is modulated by adjusting a body bias voltage of said resistor.

30. The circuit of claim 21, wherein said first and second transistors are bipolar transistors.

31. The circuit of claim 30, wherein said first and second transistors are NPN bipolar transistors.

32. The circuit of claim 21, wherein said current mirror comprises:

a third transistor having a first current handling terminal coupled to said first supply voltage, and a second current handling terminal coupled to a control terminal and to said second current handling terminal of said first transistor; and a fourth transistor having a control terminal coupled to said control terminal of said third transistor, a first current handling terminal coupled to said first supply voltage, and a second current handling terminal coupled to said output terminal of said circuit.

33. The circuit of claim 32, wherein said third and fourth transistors are MOS transistors.

34. The circuit of claim 33, wherein said third and fourth transistors are P-channel MOS transistors.

35. The circuit of claim 34, wherein said first and second transistors are NPN bipolar transistors.

36. The circuit of claim 32, wherein said first transistor has a first size and said second transistor has a second size, said first size being substantially equal to said second size, and wherein said third transistor has a third size and said fourth transistor has a fourth size, said fourth size being n times greater than said third size.

37. The circuit of claim 21, wherein said second resistor has a variable resistance, said resistance being modulated by said first bias voltage.

38. The circuit of claim 37, wherein said first bias voltage is a voltage at said second current handling terminal of said first transistor.

39. The circuit of claim 37, wherein said first bias voltage is said first supply voltage.

40. The circuit of claim 37, wherein said second resistor comprises:

a third resistor having a variable resistance being modulated by said first bias voltage, and a fourth resistor having a fixed resistance.

41. The circuit of claim 40, wherein said first bias voltage is said first supply voltage.

42. The circuit of claim 21, wherein an operating current of said circuit is less than 1 $\mu$A.

43. A voltage reference circuit comprising:

a current mirror electrically coupled to a first supply voltage, said current mirror having a first current terminal and a second current terminal, said second current terminal providing a reference voltage;

a first transistor having a first current handling terminal coupled to a second supply voltage, a second current handling terminal coupled to said first current terminal of said current mirror, and a control terminal;

a second transistor having a first current handling terminal coupled to said second supply voltage, a second current handling terminal coupled to said control terminal of said first transistor, and a control terminal coupled to a first node;

a first resistor coupled between said second current handling terminal of said second transistor and said first node, said first resistor having a variable resistance, said resistance being modulated by said first supply voltage;

a second resistor coupled between said first node and a second node, said second resistor having fixed resistance; and a third resistor coupled between said second node and said second current terminal of said current mirror, said third resistor having a variable resistance, said resistance being modulated by said first supply voltage.

44. The circuit of claim 43, wherein said current mirror comprises:

a third transistor having a first current handling terminal coupled to said first supply voltage, and a second current handling terminal coupled to a control terminal and to said second current handling terminal of said first transistor; and a fourth transistor having a control terminal coupled to said control terminal of said third transistor, a first current handling terminal coupled to said first supply voltage, and a second current handling terminal coupled to said output terminal of said circuit.

45. The circuit of claim 44, wherein said first and second transistors are NPN bipolar transistors, and said third and fourth transistors are PMOS transistors.

* * * * *